United States Patent [19]

Federgreen

[11] Patent Number: 4,739,454

[45] Date of Patent: Apr. 19, 1988

[54] ADJUSTABLE DISPLAY LIGHT

[75] Inventor: Richard Federgreen, Kotonah, N.Y.

[73] Assignee: Starbrite Lighting Ltd, Yonkers, N.Y.

[21] Appl. No.: 875,402

[22] Filed: Jun. 17, 1986

[51] Int. Cl.[4] ..... H01R 33/08

[52] U.S. Cl. ..... 362/133; 362/217; 362/277

[58] Field of Search ..... 362/133, 219, 217, 282, 362/220, 285, 269, 270, 257, 277

[56] References Cited

U.S. PATENT DOCUMENTS

| | | | |
|---|---|---|---|
| 2,286,851 | 6/1942 | Hess | 362/277 |
| 3,771,106 | 11/1973 | Matsumoto et al. | 362/217 |
| 4,074,124 | 2/1978 | Mante et al. | 362/217 |
| 4,598,341 | 7/1986 | Brackhahn et al. | 362/133 |
| 4,622,624 | 11/1986 | McCarthy et al. | 362/217 |
| 4,642,741 | 2/1987 | Cohn | 362/217 |

FOREIGN PATENT DOCUMENTS

| | | | |
|---|---|---|---|
| 3516173 | 11/1986 | United Kingdom | 312/133 |

*Primary Examiner*—Raymond A. Nelli
*Attorney, Agent, or Firm*—Darby & Darby

[57] ABSTRACT

A display lamp is provided with a generally cylindrical illumination tube, which serves as the source of light. A housing with a generally U-shaped cross section is secured over the tube so as to act as a decorative enclosure and a reflector for the tube. The housing is somewhat shorter in length than the tube and the ends of the tube protrude beyond the housing. The lamp also includes a pair of mounting members, each of which includes a generally flat top wall and a pair of depending, opposed legs which are spaced apart by a distance equal to the outside diameter of the protruding end portions of the light tube. The top surface of the top wall is provided with an adhesive for securing the lamp to the shelf. The depending legs are shaped so as to engage and retain the protruding portions of the light tube. When so engaged, the light tube and housing are rotated together so that the interior reflecting surface of the housing directs the illumination from the light tube as desired.

13 Claims, 2 Drawing Sheets

ADJUSTABLE DISPLAY LIGHT

The present invention relates generally to lighting fixtures and, more particularly, concerns a lamp which may be mounted on a shelf or similar display and positioned for different angles of illumination.

BACKGROUND OF THE INVENTION

Various types of lamps have been utilized to illuminate shelves and similar displays. This includes conventional desktype lamps which are merely rested upon the shelf to illuminate a desired location. Such lamps have the advantage that the angle and concentration of illumination are easily adjustable. However, such lamps occupy a substantial amount of space, and when the shelf is utilized for display purposes, are far too noticeable and tend to detract from the display.

Indirect lighting and various forms of strip lighting have been utilized to illuminate various forms of displays, while maintaining the source of illumination unobtrusive. However, such types of lighting tend to be relatively complicated to install and, once installed, do not permit convenient control of the direction or angle of the lighting.

Broadly, it is the object of the present invention to provide a lamp which may be utilized for shelves and other types of displays which overcome the disadvantages of existing lamps of this type.

It is another object of the present invention to provide a lamp of the type described which may quickly and conveniently be mounted on the shelf or display.

It is yet another object of the present invention to provide a lamp of the type described which is readily adjustable so as to vary the direction or angle of the illumination it provides.

It is also an object of the present invention to provide a lamp for shelves and similar displays which is convenient and reliable in use, yet relatively inexpensive in construction.

In accordance with an illustrative embodiment of the present invention, a display lamp is provided with a generally cylindrical illumination tube, which serves as the source of light. A housing with a generally U-shaped cross section is secured over the tube so as to act as a decorative enclosure and a reflector for the tube. The housing is somewhat shorter in length than the tube and the ends of the tube protrude beyond the housing. The lamp also includes a pair of mounting members, each of which includes a generally flat top wall and a pair of depending, opposed legs which are spaced apart by a distance equal to the outside diameter of the protruding end portions of the light tube. The top surface of the top wall is provided with an adhesive for securing the lamp to the shelf. The depending legs are shaped so as to engage and retain the protruding portions of the light tube. When so engaged, the light tube and housing are rotated together so that the interior reflecting surface of the housing directs the illumination from the light tube as desired.

The foregoing brief description, as well as other objects, features and advantages of the present invention will be understood more completely from the following detailed description of a presently preferred, but nonetheleess illustrative embodiment, with reference being had to the accompanying drawing, in which.

DETAILED DESCRIPTION OF THE PREFERRED EMBODIMENT

Figure 1:
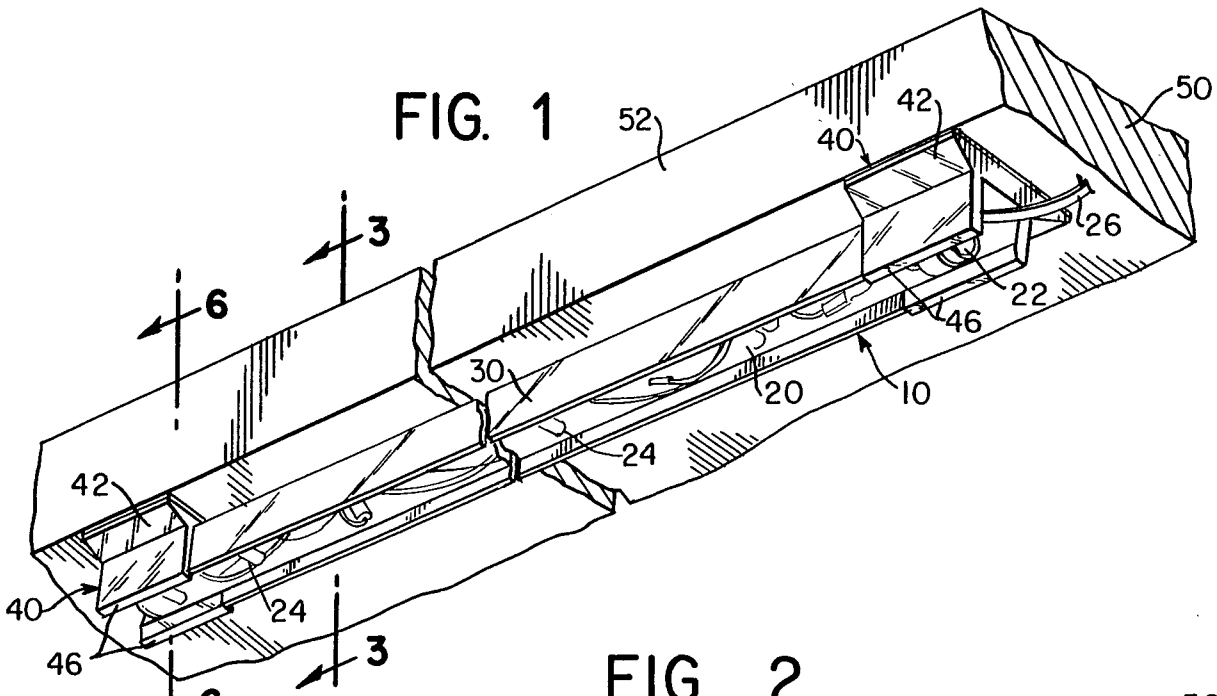
FIG. 1 is a fragmentary prospective view showing a lamp embodying the present invention, the lamp being shown in its mounted position underneath a conventional shelf.
Figure 2:
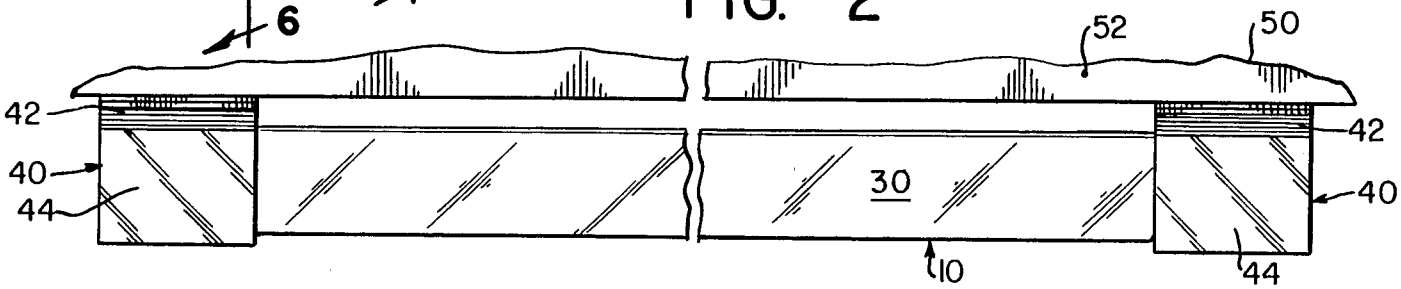
FIG. 2 is a front view of the lamp of FIG. 1.
Figure 4:
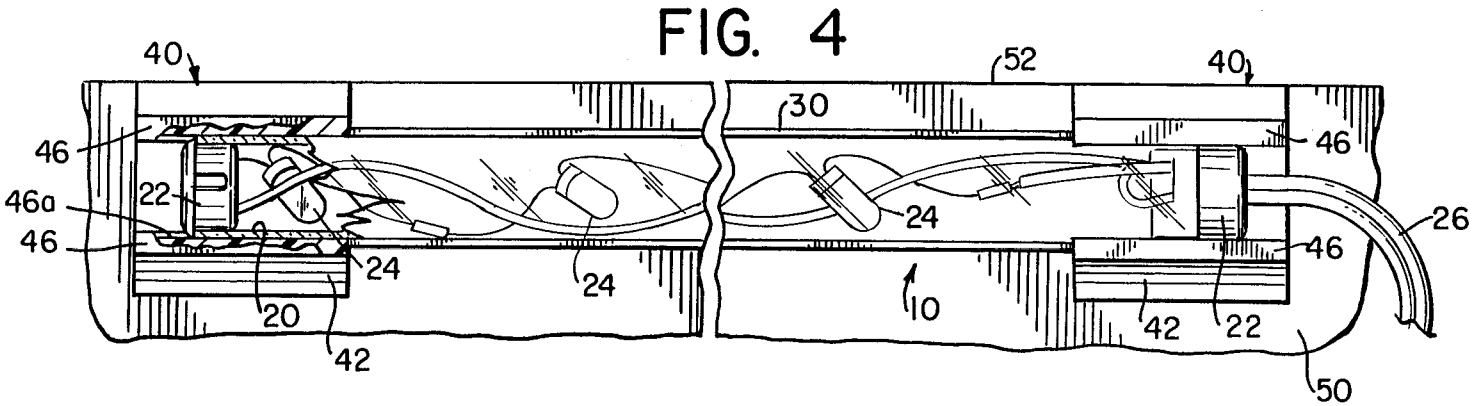
FIG. 4 is a bottom view of the lamp of FIG. 1.

Referring now to the details of the drawing, there is illustrated a lamp 10 embodying objects and features of the present invention. In FIGS. 1–6, the lamp is shown mounted beneath a conventional shelf 50 made, for example, of a slab of wood. However, the lamp could have just as well be mounted upon the top surface of the shelf or, owing to its compact construction, even along the front edge 52 of the shelf. This same compact construction also suits the lamp ideally for mounting on a picture frame. Owing to its construction, once lamp 10 is mounted, it is hardly perceptible as a lamp, but takes on the appearance of a decorative molding or similar decorative strip. Moreover, in its mounted position, lamp 10 may be tilted or rotated (compare FIGS. 3 and 5 or a continuous range), in order to aim its illumination as desired.

Lamp 10 broadly comprises: an elongated illumination tube 20 having end portions 22, 22; a housing 30 substantially coextensive with the illumination tube 20, but permitting the end portions 22, 22 to protrude therebeyond; and mounting members 40, 40, which are adapted to be mounted to the shelf 50 and to rotatably retain protruding end portions 22, 22 of tube 20.

Illumination tube 20 is preferably made of clear plastic or glass. However, it will be appreciated that it may also be translucent. Although lighting tube 20 is preferably cylindrical, it may have any cross sectional shape, so long as the protruding portions 22, 22 are substantailly circular in cross-section. In the event that tube 20 is not cylindrical, this could be accomplished, for example, by providing cylindrical inserts at either end of the tube. Within lighting tube 20, illumination is provided by a series of electrically connected lamps 24, to which power is provided by means of a power cord 26. Power cord 26 may be connected to any conventional source of power, such as an electrical wall outlet. The electrical details of lighting tube 20 are not considered to be part of the present invention, and it is contemplated that lighting tube 20 may be illuminated by any conventional means.

Housing 30 is preferably made of sheet metal or a sturdy plastic material and is formed into a generally U-shaped channel configuration so as to fit snugly over the exterior of light tube 20. In this position, housing 30 lends rigidity to light tube 20, and also protects it against possible damage. The exterior surface of housing 30 is preferably provided with a decorative finish, such as brass, bronze or chrome or it may be painted in a decorative color, and its interior surface is preferably painted so as to permit it to act as a reflector. It is preferred that the interior surface of housing 30 by provided with a white finish for this purpose. For reasons that will be explained in further detail below, housing 30 is secured with respect to lighting tube 20 so that the lighting tube may not rotate with respect to the housing.

Although housing 30 is preferably a separate structural element, for simplicity of manufacture and assembly, and for reasons of economy, it will be appreciated that lighting tube 20 could be made sufficiently thick to have substantial rigidity and strength independently of housing 30. Under these circumstances, housing 30 could be coated or painted on the exterior surface of lighting tube 20, so as to provide the necessary decorative and reflective properties.

Mounting members 40, 40 are identical. Hence, only one of them will be described. Mounting member 40 is preferably made of plastic. However, it may also be made of metal. The exterior finish of mounting member 40 is made to match or compliment that of housing 30. Housing member 40 is formed generally in the shape of a Greek letter "pi". It includes a relatively thick top wall 42 and opposed depending legs 44, 44, which are separated by a distance equal to the outside diameter of the end portions 22, 22 of lighting tube 20 (see FIG. 6). However, each leg 44 is provided with a thickened lower portion 46 which protrudes toward the opposed leg. As may be seen in FIG. 6, each thickened portion includes a tapered region **46*a* at its top. Preferably the region 46*a* is contoured to conform to the periphery of end portion 22 and is positioned so as to cradle the end portion 22 between the two tapered regions 46a and the bottom of top wall 42. In addition, the legs 44, 44 have a certain amount of resilience so that end portion 22 engages the legs 44, 44 and the bottom of top wall 42** with a certain amount of frictional resistance to rotation.

Figure 7:
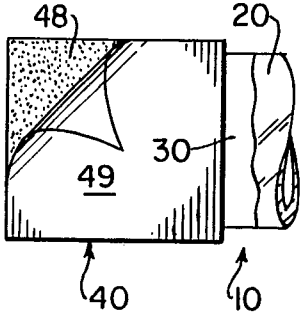
FIG. 7 is a fragmentary top view of a lamp of the type illustrated in FIG. 1, the lamp being shown prior to being mounted on the shelf.
Figure 6:
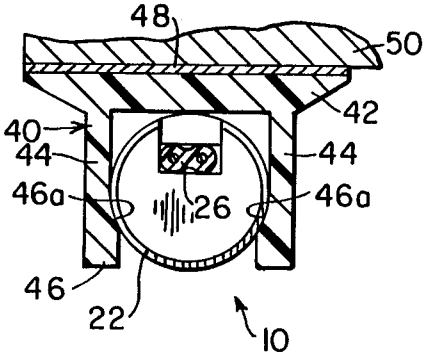
FIG. 6 is a sectional view taken along lines 6—6 in FIG. 1 and looking in the direction of the arrows.

The top surface of top wall 42 is provided with an adhesive coating 48, to permit convenient mounting of the mounting member 40 to the shelf 50. As will be appreciated from FIG. 7 the adhesive coating 48 is covered by a protective sheet 49, which is conveniently peeled off prior to mounting member 40 on the shelf 50. In order to retain member 40 more securely on shelf 50, a fastener, for example a conventional wood screw 54, is utilized. Fastener 54 is conveniently countersunk into the bottom surface of top wall 42.

Figure 5:
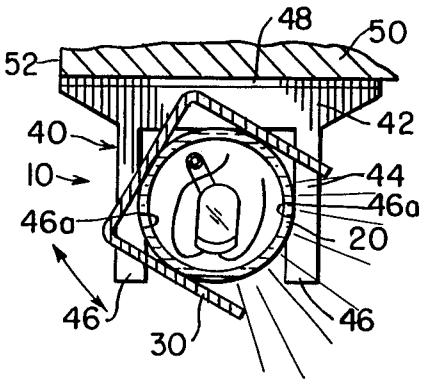
FIG. 5 is a sectional view similar to FIG. 3, the lamp being shown in an inwardly tilted position.
Figure 3:
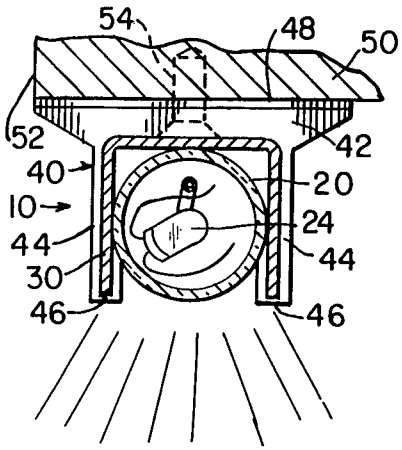
FIG. 3 is a sectional view, on an enlarged scale, taken along lines 3—3 in FIG. 1 and looking the direction of the arrows.

As will be appreciated from FIG. 5, top of wall 42 should be made sufficiently thick to permit housing 30 to rotate, without its corner coming into contact with the surface of shelf 50.

In use, lamp 10 is conveniently applied to shelf 50 in its assembled condition by peeling off the protective layers 49.

In use, lamp 10 is conveniently applied to shelf 50 in its assembled condition by peeling off the protective layers 49 and pressing the adhesive layers 48 to the surface of shelf 50. Once the lamp is so mounted on shelf 50, the end portions 22 of tube 20 may be withdrawn from their respective members 40, 40 by exerting a downward pull, and the fasteners 54 may be inserted, if desired. The end portions 22, 22 may then be reinserted into their respective mounting members 40, 40 by pressing them upwardly. Owing to the curved shape of the end portions 22, 22, the legs 44, 44 of each mounting member are then forced apart, to permit passage of the end portion 22 there between. When the end portion 22 comes into engagement with the bottom surface of top wall 42, legs 44, 44 return to their normal position, owing to their resilience, and the end portions 22, 22 are retained in frictional engagement. The housing member 30 may then be rotated to direct the illumination from tube 20, as desired, and it will retain its orientation, as a result of this frictional engagement.

Although a preferred embodiment of the invention has been disclosed for illustrative purposes, those skilled in the art will appreciate that many additions, modifications, and substitutions are possible, without departing from the scope and spirit of the invention as defined in the accompanying claims. For example, the top surface of top wall 42 of mounting members 40 need not be flat, but could be contoured, for example arcuate or circular to fit a surface of a predefined shape.

What is claimed is:

1. A lamp for mounting onto a mounting surface to provide directionally adjustable lighting, comprising:

an elongated lighting member having first and second cylindrical ends, said lighting member including means for illuminating the same along its length;

housing means substantially lengthwise coextensive with said lighting member, said housing means covering a substantial proportion of the periphery of said lighting member and having a surface facing said lighting member which is constructed to act as a reflector therefore, whereby the illumination provided by said lighting member is directed by said housing member, said housing member being sufficiently shorter than said lighting member to permit the first and second ends thereof to protrude beyond said housing member;

first and second mounting members, at least one of said mounting members having a mounting portion with a top wall shaped to conform to said mounting surface and first and second depending legs spaced by a distance substantially equal to the outside diameter of said cylindrical end portions of said lighting member, said first and second depending legs being made of a resilient material and resiliently engaging one of said cylindrical end portions therebetween so as to permit rotation of said end portions relative to said mounting members; and means for retaining said top wall of said at least one mounting member in contact with said mounting surface.

2. A lamp in accordance with claim 1 wherein said lighting member comprises a transparent, elongated cylinder.

3. A lamp in accordance with claim 1 wherein said housing means comprises a generally U-shaped channel member which is dimensioned to fit snugly over the exterior of said lighting member, whereby said housing means is mounted on said lighting member for rotation therewith.

4. A lamp in accordance with claim 1 wherein at least one of said depending legs has a thickened lower portion which protrudes toward said other leg to provide a space therebetween which is less than the outside diameter of the cylindrical end portion received in said at least one mounting member.

5. A lamp in accordance with claim 4 wherein said thickened portion includes a tapered region at its top which is positioned so as to urge said cylindrical end portion upwardly against the undersurface of said top wall.

6. A lamp in accordance with claim 5 wherein said tapered region is shaped to conform to the periphery of said end portion.

7. A lamp in accordance with claim 4 wherein each of said legs includes a thickened lower portion protruding toward the opposite leg.

8. A lamp in accordance with claim 1 wherein said top wall is sufficiently thick to avoid interference between said housing means and said mounting surface when said lighting member is rotated within said mounting members.

9. A lamp in accordance with claim 1 wherein said means for retaining comprises an adhesive coating on the top surface of said top wall.

10. A lamp in accordance with claim 3 wherein at least one of said depending legs has a thickened lower portion which protrudes toward said other leg to provide a space therebetween which is less than the outside diameter of the cylindrical end portion received in said at least one mounting member.

11. A lamp in accordance with claim 10 wherein said thickened portion includes a tapered region at its top which is positioned so as to urge said cylindrical end portion upwardly against the undersurface of said top wall.

12. A lamp in accordance with claim 3 wherein said top wall is sufficiently thick to avoid interference between said housing means and said mounting surface when said lighting member is rotated within said mounting members.

13. A lamp in accordance with claim 4 wherein said top wall is sufficiently thick to avoid interference between said housing means and said mounting surface when said lighting member is rotated within said mounting members.

* * * * *